United States Patent [19]

Oostvogels et al.

[11] Patent Number: 4,757,427

[45] Date of Patent: Jul. 12, 1988

[54] IRRADIATION DEVICE COMPRISING A SHORT ARC DISCHARGE LAMP

[75] Inventors: Franciscus M. P. Oostvogels; Charles C. E. Meulemans; Adrianus P. Severijns; Petrus J. W. Severin, all of Eindhoven, Netherlands

[73] Assignee: U.S. Philips Corporation, New York, N.Y.

[21] Appl. No.: 921,711

[22] Filed: Oct. 21, 1986

[30] Foreign Application Priority Data

Oct. 21, 1985 [NL] Netherlands ..... 8502862

[51] Int. Cl.[4] ..... F21V 7/04; H01J 5/16

[52] U.S. Cl. ..... 362/32; 362/261; 313/111

[58] Field of Search ..... 362/32, 210, 255, 261, 362/262; 313/110, 111, 112

[56] References Cited

U.S. PATENT DOCUMENTS

| | | | |
|---|---|---|---|
| 3,455,622 | 7/1969 | Cooper | 362/32 X |
| 3,596,083 | 7/1971 | Lovering | 362/32 |
| 3,770,338 | 11/1973 | Helmuth | 362/32 X |
| 3,772,506 | 11/1973 | Junginger | 362/32 |
| 4,361,863 | 11/1982 | Hagner | 362/261 |

*Primary Examiner*—Larry Jones

*Attorney, Agent, or Firm*—Algy Tamoshunas; Brian J. Wieghaus; Emmanuel J. Lobato

[57] ABSTRACT

The irradiation device comprises a short arc discharge lamp, in which a pair of electrodes are arranged, between which a discharge path extends. An optical conductor is sealed with its first end into the wall of the lamp vessel in such a manner that its light entrance window is arranged laterally of the discharge path and is directed to the discharge path.

8 Claims, 1 Drawing Sheet

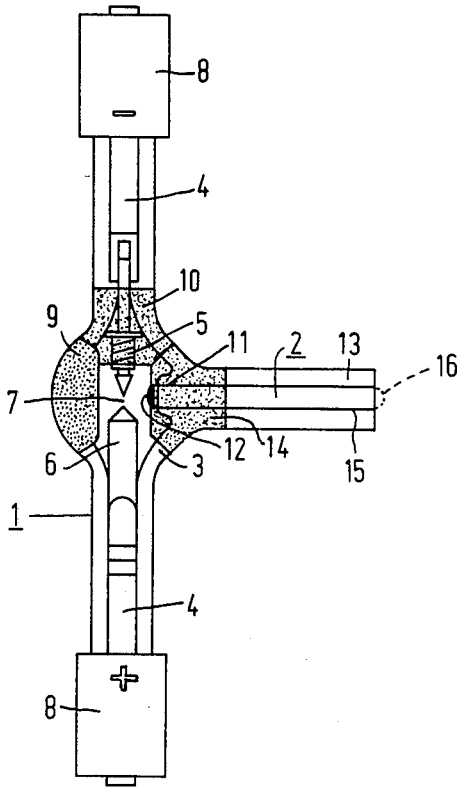
8
4
10
9
5
11
2
13
16
7
12
14
6
3
15
1
4
8

IRRADIATION DEVICE COMPRISING A SHORT ARC DISCHARGE LAMP

BACKGROUND OF THE INVENTION

The invention relates to an irradiation device comprising a high-pressure discharge lamp provided with a translucent lamp vessel, which is sealed in a vacuum-tight manner and through the wall of which current supply conductors extend to a pair of electrodes which are arranged within the lamp vessel and between which a discharge path extends, said lamp vessel being filled with an ionizable gas, and at least one optical conductor provided with a light entrance window at a first end, said optical conductor being arranged laterally of the discharge path in such a manner that the light entrance window is directed to the discharge path.

Such a device is known from U.S. Pat. No. 4,009,382. In the known device, the optical conductor and the high-pressure discharge lamp are detachably connected to each other. Although the optical conductor has a comparatively large light entrance window, the discharge path of the discharge lamp has considerably larger dimensions so that, only a small part of the generated radiation is collected by the optical conductor, this is also due to the fact that the dimension of the aperture of the optical conductors is small.

The DE-GM No. 8,313,972 (Helmut Hund KG, 3.11.1983) discloses a device in which due to a complicated construction a larger part of the generated radiation is collected by an optical conductor. In this device, radiation generated by a discharge lamp is converged by a cylindrical lens arranged beside this lamp. On the focal line of the lens a bundle of optical fibers is fanned out, which collects the converged radiation. Due to this fan of optical fibers, the quantity of collected light is enlarged, but this does not result in an increase of the brightness of the light emanating from the bundle.

The known devices have the disadvantage that the optical conductor has to be aligned with respect to the discharge lamp by the user. Furthermore, they have the disadvantage that light losses due to the reflection occur not only at the surface of the light entrance window, but also at the inner and the outer surface of the lamp vessel and, with the use of a lens, at both surfaces of the lens. These losses amount to about 4% per surface.

Devices of the aforementioned kind can be used to generate radiation and to irradiate not readily accessible regions, such as cavities in the human body. For this purpose, use may also be made of lasers cooperating with an optical conductor. Lasers afford the advantage that they have a high brightness. However, they have the disadvantage they are generally operated in a pulsed mode and that their operation requires an expensive and voluminous equipment.

The invention has for its object to provide a device of the kind mentioned in the opening paragraph, which has a very simple construction and is nevertheless capable of emitting continuously a high luminous flux via the optical conductor.

SUMMARY OF THE INVENTION

According to the invention, this invention is achieved in that the high-pressure discharge lamp is a short arc discharge lamp and the optical conductor is sealed with its first end into the wall of the lamp vessel.

Short arc discharge lamps have the favorable property that electrical energy is converted therein into radiation between electrodes at a very small relative distance. The electrode gap varies from a few tenths of a millimeter for lamps of low power (for example 0.4 mm at 50 W) to about 1 cm with very high powers (for example 9 mm at 6500 W). The discharge arc moreover is only slightly diffuse. Transverse to the imaginary connection line between the electrodes, the discharge arc has a very small dimension of a few tenths of a millimeter, for example 0.2 mm. As a result, the discharge arc has a very high brightness.

It is characteristic of short arc discharge lamps that the current supply conductors enter the lamp vessel at oppositely arranged areas and that the electrodes each project into the lamp vessel over a distance which is a multiple of the distance between the electrodes. The discharge space is mostly spherical or ovoidal, but may alternatively be cylindrical. The electrodes are arranged therein at least substantially concentrically. In order to ensure that the current supply conductors have a sufficiently low temperature at the area at which they emanate from the wall of the lamp vessel, this area is far from the relevant electrode. As a result, short arc discharge lamps have an overall length which is a few tens of times the distance between the electrodes. Nevertheless short arc discharge lamps are compact light sources which can be readily manipulated. Thus, a lamp of 50 W provided with lamp caps has, for example, a length of 5 cm.

It is advantageous if the high-pressure discharge lamp in the irradiation device according to the invention is a direct current short arc discharge lamp. The lamp has a comparatively small electrode as cathode and a comparatively large electrode as anode. The advantage of such a direct current lamp is that a large part of the generated light is emitted from a region of the discharge path which is close to the cathode and has a very high brightness.

Due to the fact that in the irradiation device according to the invention, the optical conductor is sealed with its first end into the wall of the short arc discharge lamp, the light entrance window of this optical conductor is close to the discharge arc, as a result of which a large part of the emitted radiation is incident upon the light entrance window and enters the optical conductor. If the wall portion of the discharge vessel opposite to the optical conductor is provided with a reflective coating, the quantity of the radiation thrown onto the light entrance window of the optical conductor is further enlarged.

It may be desirable when the wall portion of the discharge vessel is provided in the proximity of the optical conductor with a reflective coating to increase its temperature. For the same reason, the wall portion can be mirror-coated in the proximity of the cathode of a direct current lamp. If the device need emit radiation only via the optical conductor, the lamp vessel can be entirely or substantially entirely mirror-coated.

If desired, several optical conductors may be sealed into the wall of the discharge vessel. They may form together a bundle of optical conductors or may be arranged so as to be spread around the discharge path.

It may be recommended if the light entrance window has a convex, for example hemispherical, surface. The quantity of radiation collected by the optical conductor can be consequently enlarged.

Besides its high efficiency, the device according to the invention has the advantage that it is very simple and compact. In contrast with known devices, the user of the device according to the invention need not align the optical conductor with respect to the radiation source because the radiation source and the optical conductor form an undetachable unit.

An optical fiber or bundle of fibers can be coupled to the optical conductor in order that the radiation can be passed to the area at which it is required. The optical fiber (bundle) may have at its exit end a convex lens, by which the emanating light is focused. The optical conductor of the device according to the invention, however, may have itself a convex surface at its end remote from the first end. Possibilities of use of the irradiation devices are inter alia the exposure of body cavities for medical-diagnostic or therapeutical purposes, the illumination of objects which are observed through a microscope, the establishment of welding or soldering connections, the curing or drying of glue or lacquer.

The ionizable gas of the short arc discharge lamp may contain a rare gas. Moreover, mercury may be present. With additions as rare earth metal halides, indium halide, calcium halide or cadmium halide, the spectrum of the radiation emitted by the short arc discharge lamp can be adapted to specific uses of the irradiation device.

The irradiation device according to the invention has a sturdy mechanical construction if the optical conductor is laterally enclosed in a tube which is fused with the wall of the lamp vessel. The optical conductor may be laterally fused with this tube.

BRIEF DESCRIPTION OF THE DRAWING

An embodiment of the device according to the invention is shown in the drawing in side elevation.

DETAILED DESCRIPTION OF THE INVENTION

In the drawing, the device comprises a high-pressure discharge lamp 1 and an optical conductor 2. The discharge lamp 1 has a translucent lamp vessel 3 of quartz glass sealed in a vacuum-tight manner. Current supply conductors 4 extend through the wall of the lamp vessel to a pair of electrodes 5, 6 which are arranged within the lamp vessel and between which a discharge path extends. The lamp shown in the drawing is intended to be used for operation at direct voltage, the anode 5 being the cathode and the electrode 6 being the anode. The current supply conductors 4 are each connected to a respective lamp cap 8. The lamp vessel 3 is filled with an ionizable gas. An optical conductor 2, which has at a first end 11 a light entrance window 12, is arranged laterally of this discharge path 7 so as to be directed with the light entrance window 12 facing the discharge path 7.

The discharge lamp 1 shown in the drawing is a short arc discharge lamp, which during operation at 22 V consumes a power of 50 W. The distance between the electrodes is 0.4 mm and the ionizable filling is 10,000 Pa Xe and 11 mg Hg. During operation, the pressure of the filling increases to a few tens, e.g. 50 to 60 bar.

The optical conductor 2 is sealed with its first end 11 into the wall of the lamp vessel 3. The light entrance window 12 has a convex surface and is situated within the discharge space enclosed by the lamp vessel 3 at a distance of about 1 mm from the discharge path 7. The optical conductor 2 is laterally enclosed in and fused with a quartz glass tube 13, which is fused with the wall of the lamp vessel 3. Opposite to the light entrance window 12, the wall of the lamp vessel 3 has a reflective coating, i.e. a gold layer 9. The wall of the lamp vessel 3 further has near the cathode 5 a reflective coating 10 and near the optical conductor 2 a reflective coating to keep the lamp vessel 3 at a sufficiently high temperature during operation. The mirrors 10 and 14 are indicated in the FIGURE in such a manner that the parts enveloped thereby have remained visible. The optical conductor 2 may have at its end 15 remote from the first end 11 a convex surface 16.

Another possibility to seal the optical conductor 2 into the lamp vessel 3 consists in that a bead of doped quartz is arranged at the first end 11 around the conductor and the bead is fused with the wall of the lamp vessel 3.

The optical conductor 2 has a core of $SiO_2$ with an envelope of $SiO_2$ doped with F. Instead, another optical conductor may be used, for example an optical conductor having a high refractive index at the center line and a refractive index decreasing gradually towards the sheath, for example a conductor having a core of $SiO_2$ doped with germanium in a concentration decreasing towards the sheath and a sheath of $SiO_2$.

What is claimed is:

1. In an irradiation device comprising, in combination: a high-pressure discharge lamp comprising a translucent lamp vessel which is sealed in a vacuum-tight manner, a pair of current conductors each extending through a wall of said vessel, and a pair of electrodes each arranged on a respective one of said conductors and having a discharge path extending therebetween, said vessel being filled with ionizable gas; and at least one optical conductor having a first end with a light entrance window at said first end, said optical conductor being arranged laterally with respect to said discharge path of said lamp, the improvement comprising:

said high-pressure discharge lamp being a short arc discharge lamp, said light entrance window comprising a convex entrance window within said lamp facing said discharge path, said optical conductor comprising a central core and an outer sheath having a different refractive index than said central core, the refractive index of said central core and said outer sheath being different than that of said translucent lamp vessel, and said at least one optical conductor being disposed with its first end sealed into said wall of said lamp vessel and extending toward and terminating at said convex entrance window for receiving light through said entrance window and transmitting the light out of said high-pressure discharge lamp through said optical conductor.

2. An irradiation device as claimed in claim 1, characterized in that said at least one optical conductor is laterally enclosed in a tube fused with the wall of the lamp vessel.

3. An irradiation device as claimed in claim 2, characterized in that said at least one optical conductor is laterally fused with the tube.

4. An irradiation device as claimed in claim 2, characterized in that the wall of the lamp vessel is mirror-coated at least opposite to the light entrance window.

5. An irradiation device as claimed in claim 4, characterized in that the end of the optical conductor remote from the light entrance window has a convex surface.

6. An irradiation device as claimed in claim 2, characterized in that an end of the optical conductor remote from the light entrance window has a convex surface.

7. An irradiation device as claimed in claim 1, characterized in that an end of the optical conductor remote from the light entrance window has a convex surface.

8. An irradiation device as claimed in claim 1, characterized in that the wall of the lamp vessel is mirror-coated at least opposite to the light entrance window.

* * * * *